US005560815A

United States Patent [19]

Sekimoto et al.

[11] Patent Number: 5,560,815

[45] Date of Patent: Oct. 1, 1996

[54] ELECTROLYTIC CHROMIUM PLATING METHOD USING TRIVALENT CHROMIUM

[75] Inventors: Masao Sekimoto; Yukiei Matsumoto; Kyohei Kuroda; Takanobu Hayashi; Akio Nishi, all of Kanagawa; Mitsuo Shibata, Chiba, all of Japan

[73] Assignees: Permelec Electrode Ltd., Kanagawa, Japan; Wm. Canning Ltd., Birmingham, United Kingdom

[21] Appl. No.: 495,110

[22] Filed: Jun. 27, 1995

[30] Foreign Application Priority Data

Jun. 27, 1994 [JP] Japan ..... 6-144431

[51] Int. Cl.[6] ..... C25D 3/04

[52] U.S. Cl. ..... 205/284; 205/287; 205/243; 204/290 R

[58] Field of Search ..... 205/284, 287, 205/288, 289, 243; 204/290 R

[56] References Cited

U.S. PATENT DOCUMENTS

| | | | |
|---|---|---|---|
| 4,612,091 | 9/1986 | Benaben et al. | 205/287 |
| 5,232,576 | 8/1993 | Matsumoto et al. | 205/284 |

FOREIGN PATENT DOCUMENTS

| | | |
|---|---|---|
| 0243302 | 10/1987 | European Pat. Off. . |
| 0383470 | 8/1990 | European Pat. Off. . |
| 0475914 | 3/1991 | European Pat. Off. . |
| 1132789 | 5/1989 | Japan . |
| 7011497 | 1/1995 | Japan . |
| 2239260 | 6/1991 | United Kingdom . |

*Primary Examiner*—Kathryn Gorgos
*Assistant Examiner*—Kishor Mayekar
*Attorney, Agent, or Firm*—Sughrue, Mion, Zinn, Macpeak & Seas

[57] ABSTRACT

A chromium plating method using a plating bath comprising trivalent chromium and an electrode which is an anode comprising an electrode substrate of titanium, tantalum, zirconium, niobium or an alloy thereof, coated with an electrode catalyst comprising at least iridium oxide and, optionally, at least one of titanium, tantalum, niobium, zirconium, tin, antimony, ruthenium, platinum, cobalt, molybdenum, tungsten or an oxide thereof. The anode may be placed directly in the chromium plating bath or may be placed in an anode chamber partitioned from the chromium plating bath with an ion-exchange membrane. The chromium plating method may be a barrel plating method.

10 Claims, No Drawings

ELECTROLYTIC CHROMIUM PLATING METHOD USING TRIVALENT CHROMIUM

SUMMARY OF THE INVENTION

The present invention relates to a chromium plating method, and more particularly to a chromium plating method using trivalent chromium, and a barrel plating method using trivalent chromium, which can treat materials having a large number of complicated forms.

BACKGROUND OF THE INVENTION

Chromium plating is generally carried out in a plating bath containing hexavalent chromium. Recently, since hexavalent chromium has bad effects on the environment, etc., investigations about a trivalent chromium plating bath have proceeded. Chromium plating using a trivalent chromium bath has been proposed for a long time. Although chromium plating using a trivalent chromium plating bath has the feature that the plating adherence to a material is good without causing discoloration of the plated layer and without causing poor adherence of the plated layer to a material, unlike hexavalent chromium, the platable condition is limited. Thus, chromium plating of a material using a trivalent chromium plating bath has not yet been practically used.

A trivalent chromium plating bath has the problem that the stability of the plating liquid deteriorates when hexavalent chromium ions are formed by an anodic oxidation reaction, thereby decreasing the plating quality, etc. Thus, a chromium plating method is proposed wherein, by partitioning the plating bath into an anode chamber and a cathode chamber using an ion-exchange membrane, formation of hexavalent chromium ions is prevented.

In chromium plating, an inexpensive lead or lead alloy is generally used as the anode. However, where a lead-containing electrode is used, a sludge of the lead compound is formed which is difficult to treat, and the lead compound dissolved in the plating bath causes a reduction in the plating quality. Even where an ion-exchange membrane is used, the formation of hexavalent chromium can be avoided, but the formation of a lead compound sludge or dissolved lead compound cannot be prevented.

Thus, use of an electrode formed by coating a titanium substrate with platinum as the anode for chromium plating is described in JP-A-54-134038 (the term "JP-A" as used herein means an "unexamined published Japanese patent publication"), but the electrode does not have sufficient durability and the plating voltage increases in a relatively short period of time.

Also, for preventing the formation of hexavalent chromium at the anode, the use of an electrode comprising an alloy of iron or nickel and the oxide thereof as the anode is described in JP-B-56-43119 (the term :JP-B" as used herein means an "examined published Japanese patent publication"), and the use of a ferrite anode is described in JP-B-61-22037. However, when these electrodes are used as the anode, the formation of a sludge due to dissolution of the catalyst component which constitutes the electrode, reduction in the quality of the plated product by the adherence of the dissolved components on the surface of the plated product, or reduction in the plating efficiency is remarkable.

Also, JP-A-61-23783 and JP-A-61-26797 each describe that a plating bath is partitioned into an anode chamber and a cathode chamber using an ion-exchange membrane, an aqueous solution having dissolved therein a trivalent chromium salt is supplied to the cathode chamber, an acid solution of the same anion as that of the trivalent chromium salt is supplied to the anode chamber, an electrode comprising lead or titanium coated with a noble metal or a noble metal oxide is used as the anode where a sulfuric acid solution is used, and an electrode comprising a graphite or titanium coated with a noble metal or a noble metal oxide is used as the anode where a chloride solution is used. However, in these patent publications, only examples using a graphite electrode are described, and there are no descriptions of an electrode having a coating of a noble metal or a noble metal oxide.

SUMMARY OF THE INVENTION

Accordingly, an object of the present invention is to provide a chromium plating method and a barrel plating method using trivalent chromium, wherein the amount of hexavalent chromium formed at the anode is less and the formation of sludge at the anode or the deposition of impurities onto the plated layer can be prevented.

According to a first embodiment of the present invention, there is provided a chromium plating method using a plating bath containing trivalent chromium, which comprises using an electrode comprising an electrode substrate having formed thereon a coating of an electrode catalyst comprising iridium oxide as the anode.

According to a second embodiment of the present invention, there is provided the chromium plating method described above, wherein the anode is placed in the chromium plating bath or the anode chamber partitioned from the chromium plating bath with an ion-exchange membrane.

According to a third embodiment of the present invention, there is provided the chromium plating method described above, wherein the electrode catalyst contains at least one of titanium, tantalum, niobium, zirconium, tin, antimony, ruthenium, platinum, cobalt, molybdenum, tungsten, and the oxides thereof together with iridium oxide, and the electrode substrate comprises titanium, tantalum, zirconium, niobium, or one of the alloys thereof.

According to a fourth embodiment of the present invention, there is provided the chromium plating method described above, wherein the chromium plating is a barrel plating.

DETAILED DESCRIPTION OF THE INVENTION

The present invention is described in detail below.

The present invention is based on the finding that the electrode prepared by forming an electrode catalyst containing iridium oxide on an electrode substrate selected from titanium, tantalum, zirconium, and niobium is excellent as an anode which can be used in a plating bath containing trivalent chromium, can prevent the formation of hexavalent chromium, and can perform chromium plating over a long period of time in a stable manner without forming sludge.

It is preferred that the electrode catalyst contains at least one member selected from the group consisting of titanium, tantalum, niobium, zirconium, tin, antimony, ruthenium, platinum, cobalt, molybdenum, tungsten, and the oxides thereof together with iridium oxide, and the content of iridium oxide in the electrode catalyst is preferably from 30 to 90 mole %. Preferably, an electrode catalyst composed of iridium oxide can have improved durability if the electrode catalyst comprises a composition comprising the metal or the metal oxide described above and iridium oxide. Also, the amount of iridium oxide coated preferably is from 20 to 60 $g/m^2$ calculated as an iridium metal. If the coating amount increases, the durability of the electrode also increases, but such is economically undesirable. Therefore, it is preferred that the coating amount does not exceed 60 $g/m^2$.

For coating the electrode catalyst containing iridium oxide on the electrode substrate comprising a thin film-forming metal selected from titanium, tantalum, zirconium, and niobium, a method of coating a solution containing salts of iridium, etc. which are the metals of the electrode catalyst components and thermally decomposing the same in an oxygen-containing atmosphere or a method of sputtering, vapor deposition, plasma spray coating, etc., can be used. The thickness of the electrode substrate is not particularly limited. Further, the thickness of the coating film of the electrode catalyst is also not particularly be limited, but is generally, for example, about 5 to 10 μm.

Also, it is preferred that an intermediate layer containing at least one metal such as titanium, tantalum, niobium, zirconium, molybdenum, tungsten, tin, antimony, platinum, etc., or the oxides thereof is formed on the electrode substrate, and a coating of the electrode catalyst containing iridium oxide is then formed on the intermediate layer, because an electrode having a higher durability can be obtained as compared with an electrode that does not have an intermediate layer. The intermediate layer generally has a thickness of about 0.1 to 10 μm.

In the chromium plating method of the present invention, it is preferred to use a water-soluble trivalent chromium compound such as chromium(III) sulfate, chromium(III) chloride, chromium(III) oxalate, chromium(III) carbonate, chromium(III) hydroxide, etc., for the plating bath containing trivalent chromium. The concentration of trivalent chromium is generally 3 to 50 g/l and preferably 5 to 8 g/l. The plating bath generally contains various kinds of organic ligands for stably existing trivalent chromium in the plating bath, or improving the current efficiency, and various additives for increasing the quality of plating, such as brighteners. Therefore, it may sometimes happen that these compounds decompose by oxidation at the anode to form tarry materials. When such a reaction occurs, the plating liquid becomes unstable and the quality of the plated products obtained deteriorates. Thus, when such a problem occurs, it is preferred that the plating bath is partitioned with a diaphragm into a cathode chamber and an anode chamber such that the anode is not directly in contact with the chromium plating bath, and an aqueous solution of the salt used as the supporting electrolyte of the plating liquid or an acid is used as the anolyte. Specific examples of the anolyte are methanesulfonic acid, ammonium borate, boric acid, sulfuric acid and sodium sulfate. The diaphragm which can be used is a neutral membrane, a cation-exchange membrane, or an anion-exchange membrane.

As described above, the chromium plating method of the present invention uses, in the plating bath containing trivalent chromium, the electrode prepared by forming the electrode catalyst containing iridium oxide on the electrode substrate comprising the thin film-forming metal selected from titanium, tantalum, zirconium, and niobium as the anode. As a result, formation of hexavalent chromium is prevented and chromium plating of a material can be carried out in a stable manner over a long period of time without the formation of sludge in the plating bath. The plating conditions are that the temperature ranges from 10° to 65° C. and preferably from 30° to 50° C., pH ranges from 1 to 7 and preferably from 3.0 to 3.8, and current density ranges from 1 to 30 $A/dm^2$ and preferably from 3 to 8 $A/dm^2$.

The present invention is described in more detail by reference to the following examples, but it should be understood that the invention is not construed as being limited thereto. Unless otherwise indicated herein, all parts, percents, ratios and the like are by weight.

EXAMPLE 1

A titanium plate pickled with a hot solution of oxalic acid was coated with a hydrochloric acid solution having dissolved therein iridium chloride and tin chloride in the amounts of 40 mole % and 60 mole %, respectively, calculated as the respective metals by a brush. The titanium plate thus coated was dried at room temperature and then heat-treated at 550° C. for 20 minutes in a muffle furnace to form a layer of a composite oxide composed of iridium oxide and tin oxide. This coating operation was repeated 20 times, and an electrode coated with 25 $g/m^2$ as iridium was prepared. Using the electrode as the anode and using a trivalent chromium plating bath (Enbairo, trade name, made by Canning Co.), plating was continuously applied to a soft steel applied with nickel plating without using a diaphragm. The concentration of trivalent chromium in the plating bath was kept at a constant value by supplying chromium sulfate. The temperature of the plating bath was 40° C., the pH thereof was 5.0, the current density was 6 $A/dm^2$, and the plating time of one operation was 10 minutes. Even after passing an electric current of 100 Ah/liter, plating could be performed and the amount of hexavalent chromium formed by passing an electric current of 100 Ah/liter was 6 ppm.

Comparative Example 1

Plating was carried out in the same manner as in Example 1 except that each of the anodes described in Table 1 below was used in place of the electrode in Example 1. The results obtained are shown in Table 1 below.

TABLE 1

| Kind of Anode | Plating State | Stability of Plating Bath and Electrode |
|---|---|---|
| Lead-tin (5 wt. %) alloy electrode | Plating unapplicable at 1 Ah/l | 450 ppm of hexavalent chromium formed at 1 Ah/l |
| Platinum-plated electrode (Pt-thickness 4 μm) | Plating unapplicable at 5 Ah/l | 90 ppm of hexavalent chromium formed at 1 Ah/l |
| Ferrite electrode ($NiO.Fe_2O_3$) | Slime-form plating at 24 Ah/l | Plating liquid stained with Ni and Fe as electrode components |
| Graphite electrode | Roughness occurred at 14 Ah/l | Consumed and carbon particles floated on plating bath |
| Stainless steel electrode (SUS 304) | Slime-form plating at 14 Ah/l | Electrode consumed severely |
| Ruthenium oxide electrode | Voltage increased to make plating unapplicable at 63 Ah/l | Electrode consumed 2 ppm of hexavalent chromium at 63 Ah/l |
| Palladium electrode | Plating unapplicable at 4 Ah/l | 80 ppm of hexavalent chromium formed at 1 Ah/l |

EXAMPLE 2

In the plating bath partitioned with a cation-exchange membrane (NAFION 117, made by E. I. Du Pont de Nemours and Company), the trivalent chromium liquid and anolyte described below were filled in each chamber, respectively. Using the same iridium oxide electrode as used in Example 1 as the anode, a brass plate degreased and pickled was plated at room temperature for 10 minutes with a distance from the electrode of 10 cm and a current density of 15 A/dm$^2$, and the plating operation was repeated.

| Trivalent Chromium Liquid | |
|---|---|
| Chromium chloride | 0.8 mole/liter |
| Aminoacetic acid | 1.2 moles/liter |
| Aluminum chloride | 0.5 mole/liter |
| Ammonium chloride | 1.5 moles/liter |
| Anolyte | |
| Aluminum sulfate | 0.5 mole/liter |
| Ammonium sulfate | 1.5 moles/liter |

Replenishment of trivalent chromium was carried out with chromium chloride, and the control of pH of the liquid was carried out with sodium hydroxide.

After passing an electric current of 100 Ah/liter, plating could be carried out. The plating bath was stabilized, and damage to the electrode was not observed.

Comparative Example 2

When plating was carried out in the same manner as in Example 2 except that hydrochloric acid was used as the anolyte and graphite was used as the anode, plating became impossible at passing an electric current of 38 Ah/liter, 200 ppm of hexachromium was formed at passing an electric current of 20 Ah/liter, and the consumption of the graphite anode was observed. Also, the formation of hexavalent chromium was considered to be due to the oxidation with chlorine generated at the anode. Furthermore, since chlorine generated at the anode is toxic, the treatment of chlorine is required.

EXAMPLE 3

A titanium plate pickled with a hot solution of oxalic acid was coated with a hydrochloric acid solution having dissolved therein iridium chloride, tantalum chloride, and chloroplatinic acid in the amounts of 55 mole %, 30 mole %, and 15 mole %, respectively, calculated as the respective metals with a brush. The titanium plate thus coated was dried at room temperature and then heat-treated in a muffle furnace at 550° C. for 20 minutes to form a composite oxide layer composed of iridium oxide, tantalum oxide, and platinum. By repeating the operation cycle of coating, drying, and the heat treatment 20 times, an electrode coated with iridium oxide of 40 g/m$^2$ calculated as iridium was prepared.

Using the electrode obtained as the anode, using a trivalent chromium bath (ENVIROCHROME 90, trade name, made by Wm Canning Ltd.), and using a barrel plating apparatus, barrel chromium plating of 5 minutes was repeatedly applied to a screw made of soft steel applied with nickel plating at an average current density of 1 A/dm$^2$ and at a plating temperature of 40° C. without using a diaphragm. In this case, even after 200 times, bright plating was applicable.

Comparative Example 3

Barrel chromium plating was carried out in the same manner as in Example 3 except that each of the anodes described in Table 2 below was used in place of the anode in Example 3.

The results obtained are shown in Table 2 below.

TABLE 2

| Kind of Anode | Plating State | Stability of Plating Bath and Electrode |
|---|---|---|
| Lead-tin (5 wt. %) alloy electrode | Plating discolored at 9 times, adherence inferior | Hexavalent chromium formed plating liquid became reddish green |
| Platinum-plate electrode (Pt thickness 4 μm) | Plating unapplicable at 15 times | Hexavalent chromium formed plating liquid became reddish green |
| Ferrite electrode ($NiO.Fe_2O_3$) | Slime-form plating at 36 times | Electrode was dissolved |
| Graphite electrode | Roughness occurred at 21 times | Electrode consumed graphite particles suspended in plating liquid |
| Ruthenium oxide electrode | Voltage increased at 94 times, plating unapplicable | Electrode consumed passage of current became impossible by increase of voltage |
| Palladium oxide electrode | Plating unapplicable at 12 times | Hexa-chromium formed, plating liquid became reddish green |
| Stainless steel electrode (SUS 304) | Slime-form plating at 19 times | Electrode dissolved |

EXAMPLE 4

Using a barrel plating apparatus partitioned into a cathode chamber and an anode chamber with a cation-exchange membrane (NAFION 324, trade name, made by E. I. Du Pont de Numours and Company), the following trivalent chromium plating liquid and anolyte were filled in each of the chambers, respectively. Using the same electrode as prepared in Example 3 as the anode, a screw made of a soft steel was plated at 30° C. for 3 minutes. In this case, even after passing an electric current of 100 Ah/liter, bright plating was possible and the plating liquid and the electrode were not changed.

| Chromium Plating Liquid | |
|---|---|
| Chromium chloride | 1.0 mole/liter |
| Glycolic acid | 1.5 moles/liter |
| Ammonium chloride | 1.0 mole/liter |
| Boric acid | 0.7 mole/liter |
| Anolyte | |
| Ammonium sulfate | 1.0 mole/liter |

Comparative Example 4

When plating was carried out in the same manner as in Example 4 except that a nickel-ferrite electrode ($NiO{\bullet}Fe_2O_3$) was used as the anode, the electrode was dissolved at passing an electric current of 20 Ah/liter.

Since in the present invention, the electrode prepared by forming the electrode catalyst containing iridium oxide on the electrode substrate comprising the thin film-forming metal was used as the anode, discoloration of the plated layer and poor adhesion of the plate layer did not occur, the formation of hexavalent chromium is prevented in the plating bath containing trivalent chromium showing good adhesion of plating, and chromium plating is possible in a stable manner over a long period of time without the formation of sludge in the plating bath.

While the invention has been described in detail and with reference to specific embodiments thereof, it will be apparent to one skilled in the art that various changes and modifications can be made therein without departing from the spirit and scope thereof.

What is claimed is:

1. A method of electrolytic chromium plating a material comprising the step of:

electrolytically plating the material with chromium with an electrolytic plating bath which comprises trivalent chromium as the source of the chromium for the plating and an electrode, wherein the electrode is an anode comprising an electrode substrate coated with an electrode catalyst comprising iridium oxide.

2. The method according to claim 1, wherein the anode is placed in the chromium plating bath.

3. The method according to claim 1, wherein the anode is placed in an anode chamber partitioned from the chromium plating bath with an ion-exchange membrane.

4. The method according to claim 1, wherein the electrode substrate comprises a metal selected from the group consisting of titanium, a titanium alloy, tantalum, a tantalum alloy, zirconium, a zirconium alloy, niobium and a niobium alloy.

5. The method according to claim 1, wherein the electrode catalyst further comprises at least one metal selected from the group consisting of titanium, titanium oxide, tantalum, tantalum oxide, niobium, niobium oxide, zirconium, zirconium oxide, tin, tin oxide, antimony, antimony oxide, ruthenium, ruthenium oxide, platinum, platinum oxide, cobalt, cobalt oxide, molybdenum, molybdenum oxide, tungsten and tungsten oxide.

6. The method according claim 5, wherein the electrode catalyst further comprises at least two metals selected from the group consisting of titanium, titanium oxide, tantalum, tantalum oxide, niobium, niobium oxide, zirconium, zirconium oxide, tin, tin oxide, antimony, antimony oxide, ruthenium, ruthenium oxide, platinum, platinum oxide, cobalt, cobalt oxide, molybdenum, molybdenum oxide, tungsten and tungsten oxide.

7. The method according to claim 1, wherein the iridium oxide is present in an amount of 20 to 60 $g/m^2$.

8. The method according to claim 1, wherein an intermediate layer, comprising at least one metal selected from the group consisting of titanium, titanium oxide, tantalum, tantalum oxide, niobium, niobium oxide, zirconium, zirconium oxide, molybdenum, molybdenum oxide, tungsten, tungsten oxide, tin, tin oxide, antimony, antimony oxide, platinum and platinum oxide, is formed between the electrode substrate and the electrode catalyst.

9. The method according to claim 1, wherein the trivalent chromium is selected from the group consisting of chromium (III) sulfate, chromium (III) chloride, chromium (III) oxalate, chromium (III) carbonate and chromium (III) hydroxide.

10. The method according to claim 1, wherein the chromium plating method is a barrel plating method.

* * * * *